US010124993B2

(12) United States Patent
Willim

(10) Patent No.: US 10,124,993 B2
(45) Date of Patent: Nov. 13, 2018

(54) METHOD FOR OPERATING A CRANE AND CRANE

(71) Applicant: Liebherr-Werk Ehingen GmbH, Ehingen/Donau (DE)

(72) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 376 days.

(21) Appl. No.: 14/830,566

(22) Filed: Aug. 19, 2015

(65) Prior Publication Data

US 2016/0052755 A1 Feb. 25, 2016

(30) Foreign Application Priority Data

Aug. 22, 2014 (DE) ..... 10 2014 012 661

(51) Int. Cl.
*B66C 23/62* (2006.01)
*B66C 23/76* (2006.01)
*B66C 23/82* (2006.01)

(52) U.S. Cl.
CPC ..... *B66C 23/62* (2013.01); *B66C 23/76* (2013.01); *B66C 23/82* (2013.01)

(58) Field of Classification Search
CPC ..... B66C 23/62; B66C 23/72; B66C 23/74; B66C 23/76; E02F 9/18; B62D 49/085
See application file for complete search history.

(56) References Cited

U.S. PATENT DOCUMENTS 3,836,010 A * 9/1974 Lampson ..... B66C 23/36 212/195
4,170,309 A * 10/1979 Lampson ..... B66C 23/74 212/198
4,243,148 A * 1/1981 Lampson ..... B66C 23/74 212/196
4,316,548 A * 2/1982 Helm ..... B66C 23/36 212/196
4,349,115 A 9/1982 Lampson
4,358,021 A * 11/1982 Helm ..... B66C 23/36 212/195

(Continued)

FOREIGN PATENT DOCUMENTS

DE 20314503 U1 1/2005
DE 102012002040 A1 8/2013
EP 1934129 B1 6/2008

*Primary Examiner* — Minh Truong
*Assistant Examiner* — Juan J Campos, Jr.
(74) *Attorney, Agent, or Firm* — McCoy Russell LLP

(57) ABSTRACT

The present disclosure relates to a method for operating a crane with a traversable undercarriage, an uppercarriage rotatably mounted on the same with luffing main boom and derrick boom arranged thereon, wherein an auxiliary crane with telescopic boom as derrick ballast is connected with the crane and via the telescopic boom of the auxiliary crane the derrick ballast radius is adjusted. According to the present disclosure, a suspended ballast is lifted in addition to the auxiliary crane provided as derrick ballast for erecting the main boom, wherein first the auxiliary crane is lifted, before the suspended ballast is lifted, when necessary. The present disclosure also relates to a crane for carrying out the method.

17 Claims, 3 Drawing Sheets

(56) References Cited

U.S. PATENT DOCUMENTS

| | | | | | |
|---|---|---|---|---|---|
| 4,537,317 | A * | 8/1985 | Jensen | B66C 23/74 | 212/195 |
| 4,555,032 | A * | 11/1985 | Mick | B66C 23/74 | 180/116 |
| 4,601,402 | A * | 7/1986 | Helm | B66C 23/36 | 212/178 |
| 4,614,275 | A * | 9/1986 | Zenno | B66C 23/36 | 212/195 |
| 7,213,716 | B2 | 5/2007 | Willim et al. | | |
| 8,162,160 | B2 | 4/2012 | Zollondz et al. | | |
| 2013/0001182 | A1* | 1/2013 | Willim | B66C 23/76 | 212/276 |

* cited by examiner

METHOD FOR OPERATING A CRANE AND CRANE

CROSS REFERENCE TO RELATED APPLICATION

This application claims priority to German Patent Application No. 10 2014 012 661.7, entitled "Method for Operating a Crane and Crane," filed on Aug. 22, 2014, the entire contents of which is hereby incorporated by reference in its entirety for all purposes.

TECHNICAL FIELD

The present disclosure relates to a method for operating a crane with a traversable undercarriage, an uppercarriage rotatably mounted on the same with luffing main boom and derrick boom arranged thereon.

BACKGROUND AND SUMMARY

Large cranes, in particular large crawler cranes, require a considerable counterweight which counteracts the lifted payload and prevents tilting of the crane. This counterweight can be applied by a central ballast, an uppercarriage ballast or also by a ballast on the derrick boom. An example derrick ballast includes a ballast plate supported with respect to the ground via corresponding implements for receiving the ballast. As an alternative, a completely suspended ballast or also a derrick ballast carried by a ballast wagon is possible.

Against this background special ballast wagons have been developed, which are designed as independently driven vehicles and therefore are traversable together with the crane, in order to ensure a largely unrestricted crane operation. Such a solution is known for example from EP 1 934 129 B1, in which beside a corresponding ballast wagon, an additional counterweight in the form of a suspended ballast also is provided. As on slewing or traversing of the crane, the counterweight also should be moved, it is proposed in the reference that the non-traversable counterweight is activatable before the traversable counterweight, i.e., the counterweight lifts off before the ballast wagon. Such solutions, however, always require a complex in-house development of an appropriate ballast wagon which exclusively is used for ballasting. Furthermore, such ballast wagon must separately be transported to the construction site for use of the crane, which has a disadvantageous effect on the operating costs incurred, since the same generally depend on the required ballast mass.

A further issue for the dimensioning of the required ballast arises during the erection of long boom combinations. The boom lying on the ground has a comparatively large lever arm and therefore induces a relatively large load moment, which by far exceeds the load moments occurring later on during the crane operation. As workaround for this problem, DE 203 14 503 U1 therefore proposes to arrange the auxiliary crane required for the set-up operation of the crane as an additional ballast on the uppercarriage of the crane, in order to be able to compensate the load moments occurring during the erecting operation.

From DE 10 2012 002 040 a similar solution is known, in which additional ballast elements can be mounted on the auxiliary crane, when the weight of the auxiliary crane is not sufficient as ballast. The additional ballast elements are attached to the crawler tracks of the auxiliary crane.

During the erection of very long booms, in which a larger counterweight is required, especially for the erecting operation, the known solutions were found to be insufficient. However, this high counterweight only is required for erecting these very long booms. After erection, the long boom is operated in a steep position and comparatively only little counterweight is required. This comparatively low counterweight in crane operation can be provided wholly or at least in part by the uppercarriage ballast. In addition, an additional ballast may be necessary.

Therefore, it is the object of the present disclosure to provide an example method for operating a crane, in which for erecting very long booms, a sufficiently high counterweight easily can be provided, when necessary.

This object is solved by a method for operating a crane with a traversable undercarriage, an uppercarriage rotatably mounted on the same with luffing main boom and derrick boom arranged thereon, wherein an auxiliary crane with telescopic boom as derrick ballast is connected with the crane and via the telescopic boom of the auxiliary crane the derrick ballast radius is adjusted. Therein, for erecting the main boom, a suspended ballast is lifted in addition to the auxiliary crane provided as derrick ballast, wherein first the auxiliary crane is lifted, before the suspended ballast is lifted, when necessary.

An example crane according to the present disclosure for carrying out the method discussed above may include a traversable undercarriage, an uppercarriage rotatably mounted on the same with luffing main boom and derrick boom arranged thereon and with a crane controller, characterized in that as derrick ballast it includes an auxiliary crane and in addition a suspended ballast, which via guying means both are connected with a crossbeam which in turn is connected with the derrick boom via guy rods. Additionally or optionally, between the derrick boom and the crossbeam, a variable-length element each in the form of a hydraulic cylinder may be provided. Additionally or optionally, on the undercarriage of the auxiliary crane, receptacles for receiving the slings may be arranged on the undercarriage such that they are located closer to the crane than the overall center of gravity of the auxiliary crane, wherein the receptacles advantageously are demountable or each laterally extendable from the undercarriage.

The present disclosure relates to a method for operating a crane with a traversable undercarriage, an uppercarriage rotatably mounted on the same with luffing main boom and derrick boom arranged thereon, wherein an auxiliary crane with telescopic boom as derrick ballast is connected with the crane and via the telescopic boom of the auxiliary crane the derrick ballast radius is adjusted. According to the present disclosure, a suspended ballast is lifted in addition to the auxiliary crane provided as derrick ballast for erecting the main boom, wherein first the auxiliary crane is lifted, before the suspended ballast is lifted, when necessary.

Thus, an auxiliary crane with telescopic boom as derrick ballast is connected with the crane. The ballasting possibility for example can be employed during the regular use of the crane or already during the crane set-up operation, especially during the erecting operation of the crane main boom. Via the telescopable length of the telescopic boom, the radius of the ballast can be adjusted.

As auxiliary crane, a comparatively small crane can be used, which for example is required for the set-up operation of the crane according to the present disclosure. What is useful in particular is an auxiliary crane designed as mobile or also as crawler crane.

As compared to a conventional derrick ballast, the auxiliary crane utilized as derrick ballast has the advantage that it can independently travel on the construction site, wherein the required repositioning times of the entire crane system from one site of use to the next site of use on the construction site can be reduced considerably.

During erection of the very long booms, the auxiliary crane first is lifted from the ground as ballast, when necessary. If this ballast is not sufficient, the further suspended ballast provided according to the present disclosure additionally is lifted.

Between the derrick boom and the auxiliary crane, at least one guying advantageously can be arranged such that, from the derrick boom, guy rods are guided to a crossbeam, on which on the one hand guying means for bracing the auxiliary crane and on the other hand guying means for connection with the suspended ballast are arranged.

Advantageously, the guying means for bracing the auxiliary crane can laterally be attached to the undercarriage of the auxiliary crane via receptacles.

As already explained above, the auxiliary crane advantageously can be connected with the crane via its telescopable boom, wherein the boom tip of the auxiliary crane is directly or indirectly connected with the crane, in particular with the crane uppercarriage and/or the crane ballast receptacle and/or the crane derrick boom.

The boom of the auxiliary crane can be connected with the crane via an interposed connection adapter, wherein the connection adapter preferably is mounted on the pulley head of the auxiliary crane via the bolting points provided for a boom extension.

Between derrick boom and auxiliary crane, variable-length elements in the form of a hydraulic cylinder each, can be provided.

As a suspended ballast, a derrick ballast pallet can be attached. When necessary, further ballast stacks can be attached to the crossbeam, laterally of said pallet.

The crane according to the present disclosure for carrying out the aforementioned method includes a traversable undercarriage, an uppercarriage rotatably mounted on the same with luffing main boom and derrick boom arranged thereon and a crane controller. As derrick ballast, an auxiliary crane and in addition a suspended ballast is provided, which both are connected with a crossbeam via tensioning means which in turn are connected with the derrick boom via guy rods. Between derrick boom and crossbeam, a variable-length element each in the form of a hydraulic cylinder advantageously is provided.

On the undercarriage of the auxiliary crane, receptacles for receiving the slings advantageously are arranged such that they are located closer to the crane than the overall center of gravity of the auxiliary crane. Thereby, the upper chord of the boom constantly is subjected to a tensile load and the lower chord is subjected to a pressure load. Particularly advantageously, the receptacles are designed demountable or each laterally extendable from the undercarriage. In its normal use, the auxiliary crane thus is not limited in its maneuverability by the receptacles. In the auxiliary crane, the receptacles are extended or mounted only during the use as derrick ballast weight.

Further features, details and advantages of the present disclosure will be explained in detail with reference to an exemplary embodiment illustrated in the drawings.

DETAILED DESCRIPTION

Figure 1A:
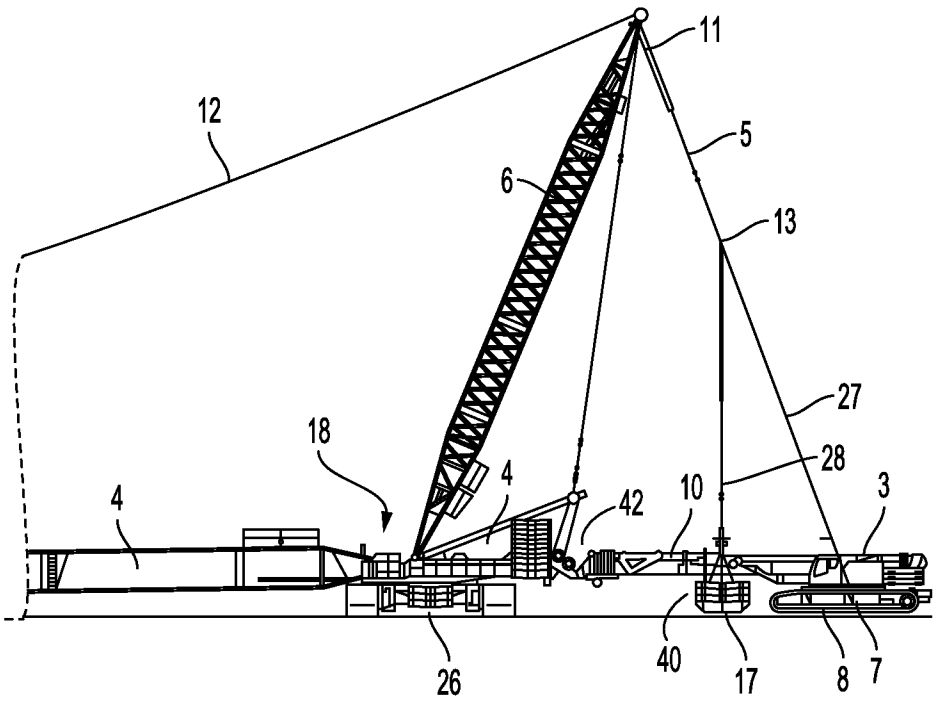
FIG. 1A shows a side view of the crane according to the present disclosure with attached auxiliary crane.
Figure 1B:
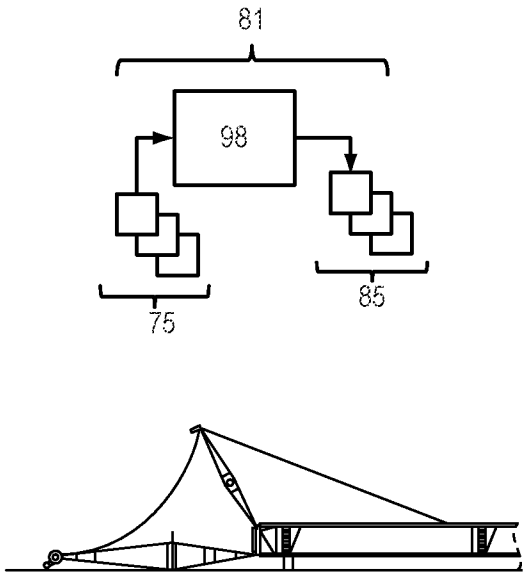
FIG. 1B shows an example crane controller.
Figure 2:
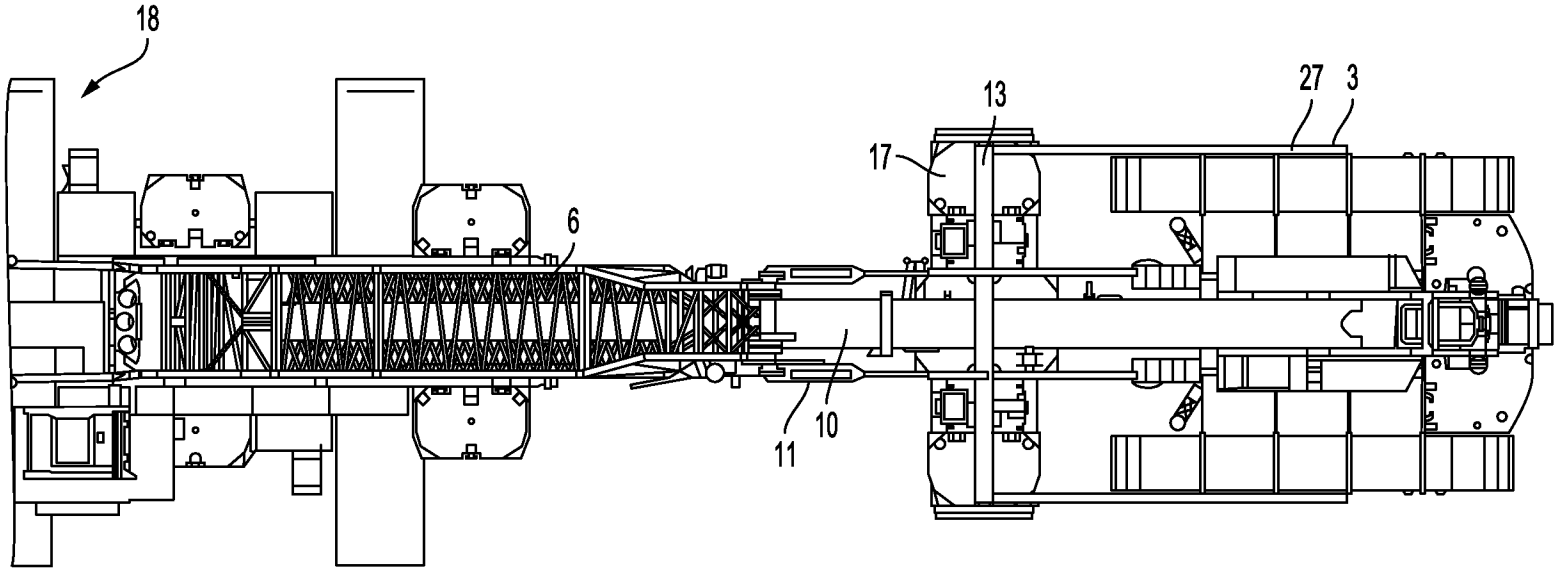
FIG. 2 shows a top view of the arrangement according to FIG. 1 (partly cut away).

With reference to FIGS. 1A, 1B, and 2, a crane 18 is shown which includes a long boom 1 attached to the uppercarriage. After erection, the long boom 1 in a manner not shown here in detail is operated in a steep position in which only comparatively little counterweight is required. At the undercarriage, outriggers, as known in the art, can be provided (not shown here) which provide for shifting of the tilt edge. The crane 18 includes a derrick boom 6 which via luffing cables 12 is connected with the long boom 1 (partly cut away in FIG. 1A). The configuration of the crane 18 corresponds to the one of DE 10 2012 002 040 A1, to which reference is made in this respect. For erecting the boom 1, as also described already in DE 10 2012 002 040 A1, a large auxiliary crane 3 as known is connected with the uppercarriage 4 of the crane 18. For this purpose, several guy rods 5 are provided on the derrick boom 6. The guy rods 5 are connected with a crossbeam 13 on which guying 27 for connection with the auxiliary crane 3 and guying 28 for connection with an additional ballast 17 are arranged. The guying 27, which on the one side is hung in on the crossbeam 13, is attached to the auxiliary crane via receptacles 8 arranged on its crawler tracks 7, for example, in a hung in arrangement.

The receptacles 8 can be designed shiftable or demountable. In its normal use, the auxiliary crane 3 thus is not limited in its maneuverability by the receptacles 8. During use as a derrick ballast weight, the receptacles 8 are extended or mounted. The receptacles 8 are spaced more than the guy rods 5 guided away from the derrick boom 6. By the crossbeam 13 arranged on the guy rods 5, the widths can be adjusted to each other. The receptacles 8 are arranged on the crawler tracks such that they are located closer to the crane 18 than the overall center of gravity of the auxiliary crane 3. It thereby is ensured that the upper chord of the boom 10 of the auxiliary crane 3, which is designed for tensile load, and the lower chord of the boom 10 of the auxiliary crane 3, which is designed for pressure load, are loaded optimally also during erection.

The auxiliary crane 3 is very heavy and utilizes its entire mass as derrick ballast. However, the same has its limitations and it can occur that even more counter-moment is required. Via the boom 10, the radius of the derrick ballast now can be adjusted in principle. The boom 10 is bolted during this use and can pick up its maximum load. Hence, if the auxiliary crane 3 with its entire mass and with fully extended boom 10 is not sufficient, the further derrick ballast weight 17 is lifted after lift-off of the auxiliary crane 3. The derrick ballast weight 17 is connected with the crossbeam 13 via guying 28, depicted herein as slings 28. When a usually employed derrick ballast pallet is not sufficient, further one or more additional ballast stacks 40 possibly can be hung in beside the derrick ballast pallet at the projecting end points of the crossbeam 13 via their own slings, when the crossbeam is designed with a corresponding length.

As shown in FIG. 1A, variable-length elements in the form of hydraulic cylinders 11 are provided in the corresponding guying between the derrick boom 6 and the auxiliary crane 3.

Between both cranes, a data and signal exchange can be provided. The same can be effected via radio or also via cable. A remote control of the auxiliary crane 3 also is possible. The operator of the auxiliary crane 3 must not stay in the crane cabin during the utilization of the auxiliary crane 3 as derrick ballast weight.

When the long boom 1 is to be erected, the cylinder 11 is retracted and introduces its force into the derrick boom 6. A first maximum force is reached, when the auxiliary crane 3 lifts off from the ground. In the process, the telescopable boom swivels about the articulation point at the uppercarriage 4 of the crane 18 via a correspondingly provided adapter. Thus, the auxiliary crane 3 swivels in the luffing plane of the long boom 1. A diagonal pull, which is particularly detrimental for crane booms, thereby is avoided.

With the solution described above, different cranes with different uses can be equipped with additional ballast which is required for erecting the long boom. In case a part of the derrick ballast necessary for erection also is required during the hoisting work, the auxiliary crane can be removed after erecting the long boom 1 and the remaining derrick ballast can be left at the crane as suspended ballast. This can be supported by a corresponding division of the individual weights and of the adjusted radius. The derrick boom 6 can change its radius by luffing.

At each element of the derrick ballast, monitoring can be provided as to whether the respective element actually has lifted off the ground. The data can be transmitted to a crane controller, such as electronic control system 81 shown in FIG. 1B. For example, various modules and/or interfaces that include control routines may be stored in the memory of an electronic control system 81 of the crane. As shown in FIG. 1B, the electronic control system 81 may be communicatively coupled with sensors 75, actuators 85, and/or displays for receiving data including input information, sensor information, and for sending actuator control and/or display information. The electronic control system 81 may include a processor and memory 98, in combination with sensors and actuators, to carry out the various controls described herein.

Rotating of the uppercarriage 4 thus can be prevented, when necessary. Traveling or rotating of the uppercarriage in connection with a part of the derrick ballast on the ground is not provided. In the working state, all ballast is a suspended ballast.

Figure 3:
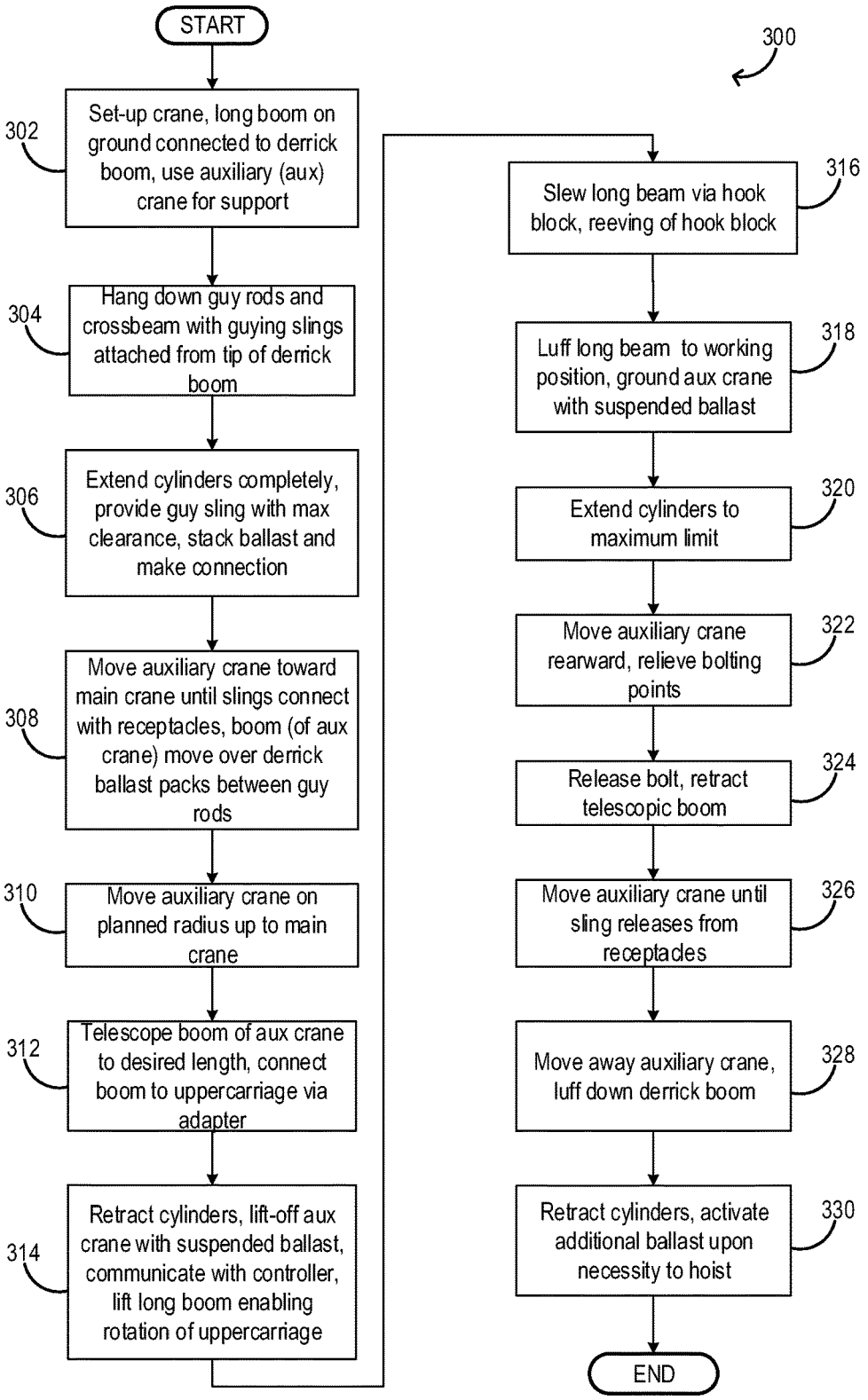
FIG. 3 shows an example method 300 for operating the crane with the attached auxiliary crane, according to the present disclosure.

With the above-described crane, particularly long booms can be erected according a method 300 of FIG. 3, described as follows. At 302 of method 300, the crane 17 is set-up, wherein the stretched long boom 1 lies on the ground and is connected with the derrick boom 6 via luffing cables 12. During the assembly, the auxiliary crane 3 can be used in support. At 304 of method 300, the guy rods 5 and the crossbeam 13 with guying slings 27 and 28 attached thereto hang down from the tip of the derrick boom. At 306 of method 300, cylinders 11 are extended completely, in order to provide the guying slings 27 and 28 with as much clearance as possible. The further suspended ballast 17 is stacked at the specified position and the connection is made. At 308 of method 300, the auxiliary crane 3 moves towards the crane 18 with retracted boom 10 in extension of the longitudinal axis of the long boom 1. The crane moves forward, until the slings 27 can be brought in connection with the extended receptacles 8. The boom 10 moves over the derrick ballast packs between the guy rods. At 310 of method 300, the crane 3 moves on its planned radius up to the crane 18. At 312 of method 300, the boom 10 of the crane 3 is telescoped to its desired length and the sections are bolted. The boom is connected with the uppercarriage via an adapter. At 314 of method 300, the cylinders 11 are retracted and they introduce the required force into the derrick boom 6. This is continued until lift-off from the ground of the entire derrick ballast, i.e. of the auxiliary crane 3 on the one hand and subsequently of the suspended ballast 17 on the other hand. Lift-off of the entire derrick ballast can be communicated to the crane controller. The booms, i.e. the long boom 1 of the crane 18 and the boom 10 of the crane 3, are not aligned completely. In the adapter for connection of the boom 10 to the uppercarriage 4 of the crane 18, sensors are arranged which announce that the counterpart is present. With a temporal overlap, the long boom 1 is lifted by retracting the luffing cables. When the long boom 1 has been lifted to such an extent that the hook block can be reeved, rotating of the uppercarriage is enabled under certain sensor-monitored conditions. The same might consist in that the cylinders 11 must carry at least 80% of the derrick ballast, since possible measurement errors can be present. On the other hand, the sensor-monitored condition can consist in that the entire derrick ballast is lifted off the ground. At 316 of method 300, slewing of the long boom 1 via the hook block and reeving of the hook block occurs. At 318 of method 300, the long boom 1 is luffed up into its working position. The counter-moment of the auxiliary crane 3 no longer is required. The auxiliary crane 3 and possibly the remaining suspended ballast can then be put down on the ground. At 320 of method 300, maximum extension of the cylinders 11 occurs. At 322 of method 300, the auxiliary crane 3 is moved rearwards to relieve the bolting points 42. At 324, the method includes releasing the bolting and telescoping in. At 326 of method 300, the auxiliary crane 3 is moved forwards, until the slings 27 can be released from the receptacles. At 328, the auxiliary crane 3 is moved away. The same can again work as independent crane. To maintain the radius of the additional ballast also during the hoisting work, the derrick boom 6 may be luffed down correspondingly. Finally, at 330, the method includes possibly retracting the cylinders 11. Possibly remaining, additional ballast 17 thereby can be activated again and be lifted off the ground, when this is necessary for the hoisting task.

In principle, the guying slings 27 also can be handled manually. Thus, when the slings 27 should be suitable for hanging into the receptacles 8 by hand, some of the steps (such as the steps of the auxiliary crane 3 moving towards the crane 18 with retracted boom 10 in extension of the longitudinal axis of the long boom 1, the crane moves forward, until the slings 27 can be brought in connection with the extended receptacles 8, the boom 10 moving over the derrick ballast packs between the guy rods, the crane 3 moving on its planned radius up to the crane 18, the boom 10 of the crane 3 being telescoped to its desired length and the sections being bolted, and the boom being connected with the uppercarriage via an adapter) of the aformentioned sequence of steps during set-up and some of the steps during releasing of the auxiliary crane 3 (such as the steps of moving the auxiliary crane 3 rearwards to relieve the bolting points 42 followed by releasing the bolting and telescoping in, and the auxiliary crane 3 moving forwards, until the slings 27 can be released from the receptacles) may be adapted correspondingly.

The movement of the crane 18 advantageously is limited in terms of control during the process described above. Preferably, the traveling drive of the undercarriage can be blocked. Rotating of the uppercarriage also can be blocked correspondingly. The slings 27 and 28 preferably can be plastic slings.

The auxiliary crane 3 has a load hook which is reeved at its boom 10. The load hook can be connected with the derrick ballast pallet. Its counterweight thereby acts with a greater radius and it cannot be damaged on the ground.

The sensors in the adapter are used when rotating, in order to detect striking of the entire derrick ballast against an obstacle and stop the rotary movement.

The invention claimed is:

1. A method for operating a crane with a traversable undercarriage, an uppercarriage rotatably mounted on the undercarriage with a luffing main boom and a derrick boom arranged thereon, wherein an auxiliary crane with telescopic boom, the auxiliary crane provided as a derrick ballast, is connected with the crane and via the telescopic boom of the auxiliary crane the derrick ballast radius is adjusted, wherein during erecting of the main boom, a suspended ballast is lifted in addition to the auxiliary crane, wherein first the auxiliary crane is lifted, before the suspended ballast is lifted, and wherein at least one guying is arranged between the derrick boom and the auxiliary crane such that guy rods are guided from the derrick boom to a crossbeam, on which a first guying for bracing the auxiliary crane and a second guying for connecting with the suspended ballast are arranged.

2. The method according to claim 1, wherein the guying for bracing the auxiliary crane is laterally attached to an undercarriage of the auxiliary crane via receptacles.

3. The method according to claim 2, wherein the auxiliary crane is connected with the crane via the telescopic boom, wherein a boom tip of the auxiliary crane is directly or indirectly connected with one or more of the uppercarriage of the crane, at least one of the receptacles, and the derrick boom of the crane.

4. The method according to claim 3, wherein the telescopic boom of the auxiliary crane is connected with the crane.

5. The method according to claim 1, wherein between the derrick boom and the auxiliary crane, a variable-length element is provided, the variable-length element including a hydraulic cylinder.

6. The method according to claim 1, wherein the suspended ballast includes a derrick ballast pallet.

7. The method according to claim 6, wherein one or more additional ballast stacks are attached to the crossbeam, the one or more additional ballast stacks attached lateral to the derrick ballast pallet.

8. The method of claim 1, further comprising:

while erecting the main boom, connecting the auxiliary crane with the telescopic boom as the derrick ballast to the crane; and via the telescopic boom of the auxiliary crane, adjusting a radius of the derrick ballast.

9. A crane, comprising:

a traversable undercarriage;

an uppercarriage rotatably mounted on the undercarriage with a luffing main boom and a derrick boom arranged thereon;

a derrick ballast including an auxiliary crane, and a suspended ballast, the auxiliary crane and the suspended ballast connected via guying slings to a crossbeam, the crossbeam connected to the derrick boom via guy rods; and a crane controller, wherein a variable-length element is provided between the derrick boom and the crossbeam, the variable-length element including a hydraulic cylinder.

10. The crane according to claim 9, wherein on an undercarriage of the auxiliary crane, receptacles for receiving the guying slings are arranged such that the receptacles are located closer to the crane than an overall center of gravity of the auxiliary crane, wherein the receptacles are demountable or each laterally extendable from the undercarriage of the auxiliary crane.

11. The crane of claim 9, wherein the crane controller is configured with computer-readable instructions stored on non-transitory memory for:

during erecting of the main boom, lifting the suspended ballast in addition to the auxiliary crane, the auxiliary crane lifted before the suspended ballast is lifted.

12. A method for a crane, comprising:

during erecting of a main boom of the crane, operating an auxiliary crane as a derrick ballast;

lifting the auxiliary crane before lifting a suspended ballast;

coupling at least one guying sling between a derrick boom of the crane and the auxiliary crane; and guiding guy rods from the derrick boom to a crossbeam on which a first guying sling for bracing the auxiliary crane and a second guying sling for connecting with the suspended ballast are arranged.

13. The method of claim 12, wherein the crane includes a traversable undercarriage, an uppercarriage rotatably mounted on the undercarriage, and each of a luffing main boom and a derrick boom arranged on the uppercarriage, and wherein operating the auxiliary crane as a derrick ballast includes adjusting a radius of the derrick ballast via a telescopic boom of the auxiliary crane connected with the crane.

14. The method of claim 12, further comprising laterally attaching the first guying sling for bracing the auxiliary crane to an undercarriage of the auxiliary crane via one or more receptacles.

15. The method of claim 12, wherein the suspended ballast includes a derrick ballast pallet.

16. The method of claim 12, further comprising attaching one or more ballast stacks to the crossbeam in addition to the suspended ballast, the one or more ballast stacks attached lateral to the suspended ballast.

17. The method of claim 12, wherein the crane further includes the derrick boom, and wherein operating the auxiliary crane as a derrick ballast includes operating a telescopic boom of the auxiliary crane as the derrick ballast.

* * * * *